US006241123B1

(12) United States Patent
Elmore

(10) Patent No.: US 6,241,123 B1
(45) **Date of Patent: *Jun. 5, 2001**

(54) BULK FOOD DISPENSING APPARATUS

(75) Inventor: James N. Elmore, Little Rock, AR (US)

(73) Assignee: Trade Fixtures, LLC, Little Rock, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/569,644

(22) Filed: May 12, 2000

Related U.S. Application Data

(63) Continuation-in-part of application No. 09/513,503, filed on Feb. 25, 2000, now Pat. No. 6,182,865.

(51) Int. Cl.[7] ..... B67D 5/06

(52) U.S. Cl. ..... 222/129; 222/154; 222/155; 222/160; 222/181.1; 222/517; 222/542; 222/560

(58) Field of Search ..... 222/129, 154, 222/155, 181.1, 160, 516, 517, 542, 559, 560, 609, 612

(56) References Cited

U.S. PATENT DOCUMENTS

| | | | | |
|---|---|---|---|---|
| 367,599 | * | 8/1887 | Conant | 222/559 X |
| 557,274 | | 9/1896 | Kade . | |
| 670,792 | | 9/1901 | Lippincott . | |
| 1,184,379 | | 5/1916 | Ritter . | |
| 1,224,136 | | 5/1917 | Caskey . | |
| 1,225,797 | | 5/1917 | Gardner . | |
| 1,771,545 | | 7/1930 | Melvin . | |
| 1,907,773 | * | 5/1933 | Fisher et al. | 222/560 X |
| 2,131,651 | * | 9/1938 | Woo | 22/517 X |
| 2,150,753 | * | 3/1939 | Weinstein | 222/517 |
| 2,447,409 | * | 8/1948 | Gulow | 222/517 X |
| 2,663,466 | * | 12/1953 | Hetzel | 222/517 X |
| 3,146,924 | * | 9/1964 | Cozadd et al. | 222/517 X |
| 4,349,128 | | 9/1982 | Sanfilippo | 222/166 |
| 4,903,866 | | 2/1990 | Loew | 222/129 |
| 5,308,158 | | 5/1994 | Vogelsong et al. | 312/319.3 |
| 5,437,393 | | 8/1995 | Blicher et al. | 222/77 |
| 5,529,219 | * | 6/1996 | Ward | 222/181.1 X |

* cited by examiner

*Primary Examiner*—Kenneth Bomberg
(74) *Attorney, Agent, or Firm*—James R. Eley; Jason D. Vierra-Eisenberg; Arter & Hadden

(57) ABSTRACT

An apparatus comprises first and second side pieces configured to be hingedly connected and to form a first and second cavity, a lid, and a front piece configured to form a third cavity with the first and second side pieces. Also included are a handle, a biasing device configured to be positioned outside the first cavity, and a rotating blocking device configured to rotate based on movement of the handle and the biasing device, such that handle and rotating block device are returned to a stationary position based on the biasing device. Finally, the apparatus includes a resilient sealing device that is configured to interact with the rotating blocking device to close a first opening between the first and second cavities and a swinging blocking device configured to close a second opening between the first and third cavities. Also according to the present invention, in another embodiment the closing device includes a holding device that has first through forth side walls and a base. The closing device can be used to hold a receptacle while it is being filled and to catch any spillover.

3 Claims, 17 Drawing Sheets

BULK FOOD DISPENSING APPARATUS

RELATED CASES

This application is a continuation-in-part of U.S. patent application Ser. No. 09/513,503, now U.S. Pat. No. 6,182,865 filed Feb. 25, 2000 entitled "Bulk Food Dispensing Apparatus" to Elmore.

BACKGROUND OF THE INVENTION

This invention relates generally to dispensing apparatus and, more particularly, to a gravity feed dispensing bin apparatus. This apparatus allows bulk material that is loaded through an inlet to flow under the force of gravity to an outlet from which the product is dispensed.

Traditionally, gravity feed bins for dispensing bulk materials are used to dispense a wide variety of materials having a range of sizes and aggregate make-ups as diverse as hardware components, e.g., nuts and bolts, to food, e.g., nuts, cereals, pastas, coffee (either beans or ground), dried soup mixes, candies, spices, and the like. Generally, the bins are comprised of enclosures having an inlet at an upper end utilized to fill a cavity, an outlet at its lower end utilized to dispense the material, and a flow control device located between the upper and lower openings for controlling the amount of materials being dispensed. In operation, as the material is being dispensed gravity pulls the remaining material in the cavity towards the lower end to replace the dispensed material. These types of bins generally include a downwardly curving inner wall that forms a chute to channel the dispensed materials into a receptacle adjacent the outlet.

Examples of prior art gravity feed bins can be found in U.S. Pat. No. 4,903,866 to Loew and U.S. Pat. No. 5,437,393 to Blicher et al, and NewLeaf Designs' Vita-Bin®.

Unfortunately, these prior art systems have many shortcomings. They are labor intensive to make since pieces have to be cut and glued together, they are hard to clean because of comers in glued joints, they do not fit well into modular systems with each other, and they cannot be easily disassembled for cleaning without the use of tools. Also, parts of the device for biasing the movement of the output door were required to be passed through the food. The result of all this is that most of the prior art devices are not qualified for certification by NSF International, which is an independent laboratory for certifying food processing equipment.

Another problem with the prior art devices is that if a customer is dispensing either a heavy bulk material or the customer dispenses a large amount of the bulk material it becomes burdensome to hold onto the receptacle. When this occurs a customer might stop dispensing the bulk material sooner than they might desire, which results in a loss of some of the sale. Another result might be that the customer loses control of the bag and spills some of the bulk material onto the floor, which causes a mess that is unsafe, unsanitary, and unsightly.

What is needed is a bulk food dispensing apparatus that is easily manufactured, assembled, and cleaned, which also assists customers when dispensing either heavy bulk material or a large volume of the bulk material.

SUMMARY OF THE INVENTION

This present invention overcomes all these abovementioned shortcomings of the prior art devices.

According to the present invention, an apparatus comprises first and second side pieces configured to be hingedly connected and to form a first cavity, a closing device, and a front piece configured to form a third cavity with the first and second side pieces. Also included are a handle, a biasing device configured to be positioned outside the first cavity, and a rotating blocking device configured to rotate based on movement of the handle and the biasing device, such that handle and rotating block device are returned to a stationary position based on the biasing device. Finally, the apparatus includes a sealing device that is configured to interact with the rotating blocking device to close a first opening between the first and second cavities and a swinging blocking device configured to close a second opening between the first and second cavities.

Also according to the present invention, in another embodiment the closing device includes a holding device that has first through forth side walls and a base. The closing device can be used to hold a receptacle while it is being filled and to catch any spill-over.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF THE INVENTION

Figure 1:
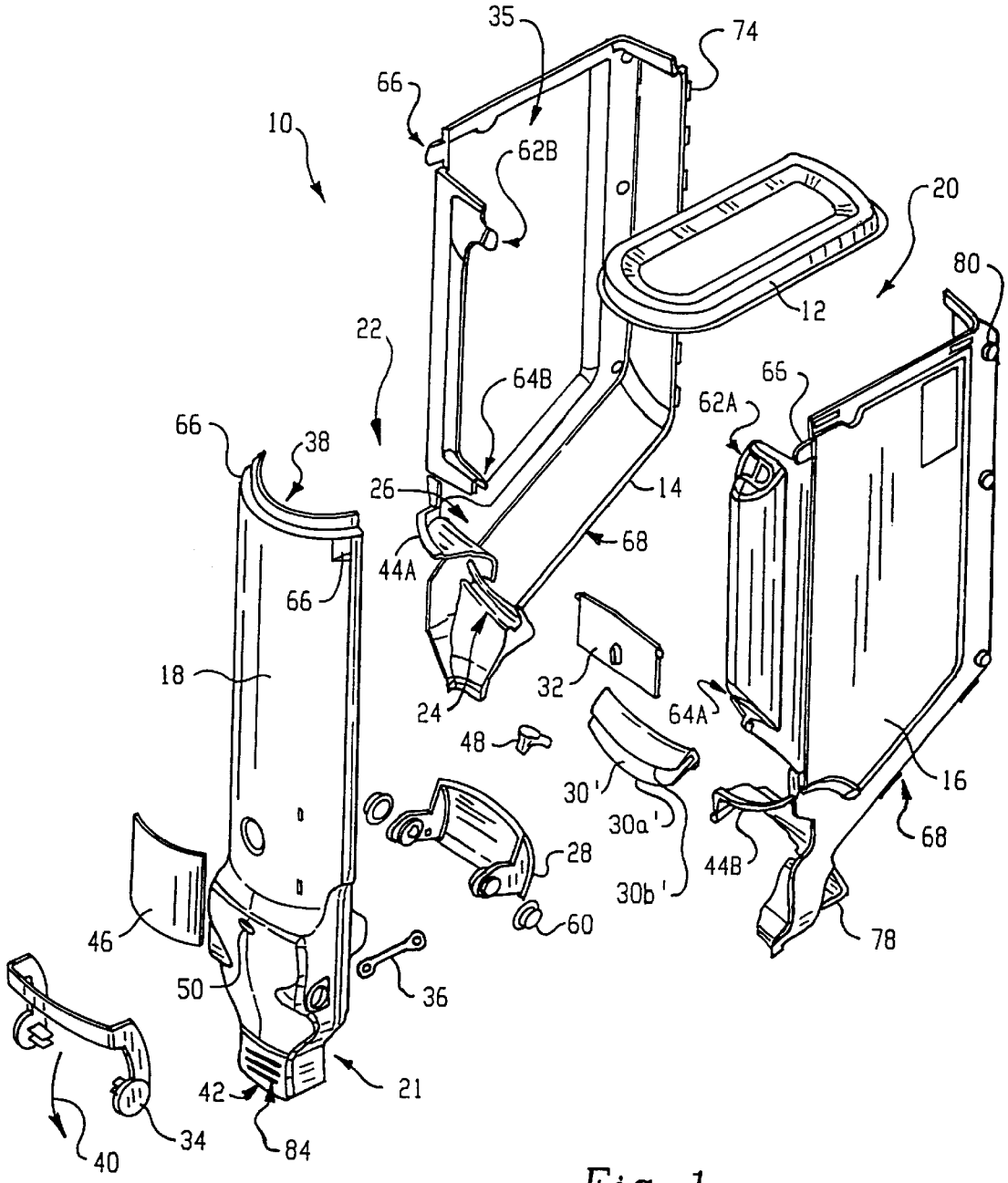
FIG. 1 is an exploded view of a gravity feed bin according to a preferred embodiment of the present invention.

An exploded view of an apparatus 10 according to a preferred embodiment of the present invention is shown in FIG. 1. Preferably, the apparatus 10 is material holding device, e.g., a gravity feed bin.

Further examples of gravity feed bins are found in U.S. Design Pat. Nos. D286,728, D326,983 and D413,767 all to Elmore, the inventor of the present invention, which are incorporated herein by reference.

With continuing reference to FIG. 1, the bin 10 includes a lid 12, a left side piece 14, a right side piece 16, and a front piece 18. The lid 12 and left and right side pieces 14, 16 interconnect to form an enclosure that defines a first cavity 20 (see also FIGS. 2A–2B). Also, the front piece 18 and the left and right side pieces 14, 16 interconnect to form an enclosure that defines a second cavity 21 and third cavity 22 (see also FIGS. 2A–2B). Preferably, the left and right side pieces 14, 16 and front piece 18 are molded from a clear plastic material, such as polycarbonate, and the lid 12 is made from a more flexible plastic material, such as polypropylene material. However, as can be appreciated, a variety of other materials may be employed in place of the preferred plastics.

Also with reference to FIG. 1, through the interconnection of the left and right side pieces 14, 16 a lower first opening 24 and an upper second opening 26 are defined. The first opening 24 can be substantially blocked by use of a rotating door 28 when the rotating door is in engagement with sealing device 30 (as seen in FIGS. 3A–C and 4B–C) or 30' (as seen in FIG. 1). Preferably, sealing device 30' comprises first and second flexible members, 30'*a* and 30'*b*, respectively, conforming to the rotating door 28 and sealing device 30 comprises a single flexible member conforming to the rotating door 28. The sealing devices 30' and 30 interact with the rotating door 28 in an analogous manner. The second opening 26 can be substantially blocked by use of a swinging door 32. In a preferred embodiment, the rotating door 28 is made from a plastic, such as polycarbonate, and the sealing device 30 is molded from a pliable plastic material, such as TPE VistaFlex® material manufactured by Advanced Elastomer Systems or Alcryn® material from Advanced Polymer Alloys or Savrene® material from V1-Chem Corporation. This material preferably contains coloring pigment such as brown to mask discoloration that may be imparted to the soft plastic by some bulk materials such as coffee beans. Also, preferably, the swinging door 32 is a false/gravity door located between the first and second cavities 20 and 22, and is preferably made from the same plastic material, as side pieces 14, 16. The rotating door 28 is normally actuated by pulling downward on an external handle 34 coupled to front piece 18.

During operation, upon removal of lid 12, bulk material (not shown) is loaded into the first and third cavities 20 and 22, respectively, of apparatus 10 through first and second inlets 35 and 38, respectively. First inlet 35 is defined by the interconnection of the left and right side pieces 14 and 16, respectively, and forms the mouth of first cavity 20. A second inlet 39 is difined by the interconnection of the left and right side pieces 14 and 16, respectively, and front piece 18. This interconnection forms the mouth of third cavity 22. Filling of the third cavity 22 via the first cavity 20 and the second inlet 38 provides a frontal display of the bulk material contained within the first cavity 20. Once the bin 10 has been loaded with bulk materials, lid 12 is placed atop the bin to cover the first and second inlet 35 and 38, repsectively.

In operation, after the volume or amount of the bulk material remaining in the first cavity 20, reaches a predetermined level, swinging door 32 is permitted to swing open allowing the displayed material contained in the third cavity 22 to flow into the first cavity 20 through the second opening 26. This occurs because once the bulk material in first cavity 20 drops below swinging door 32 the retained force previously exerted by the bulk materials is removed thus permitting the swinging door to rotate into an open condition to form second opening 26. In this manner, the bulk material displayed in the third cavity 22 continually mixes with the bulk material in the first cavity 20, thus preventing the displayed materials from becoming stale.

The bulk material is contained in third cavity 22 through use of a sloped base 44. This sloped base 44 is formed through the interconnection of a first base piece 44A extending from the left side piece 14 and a second base piece 44B extending from right side piece 16. This formation occurs when left and right side pieces 14, 16 are interconnected.

Figure 2A:
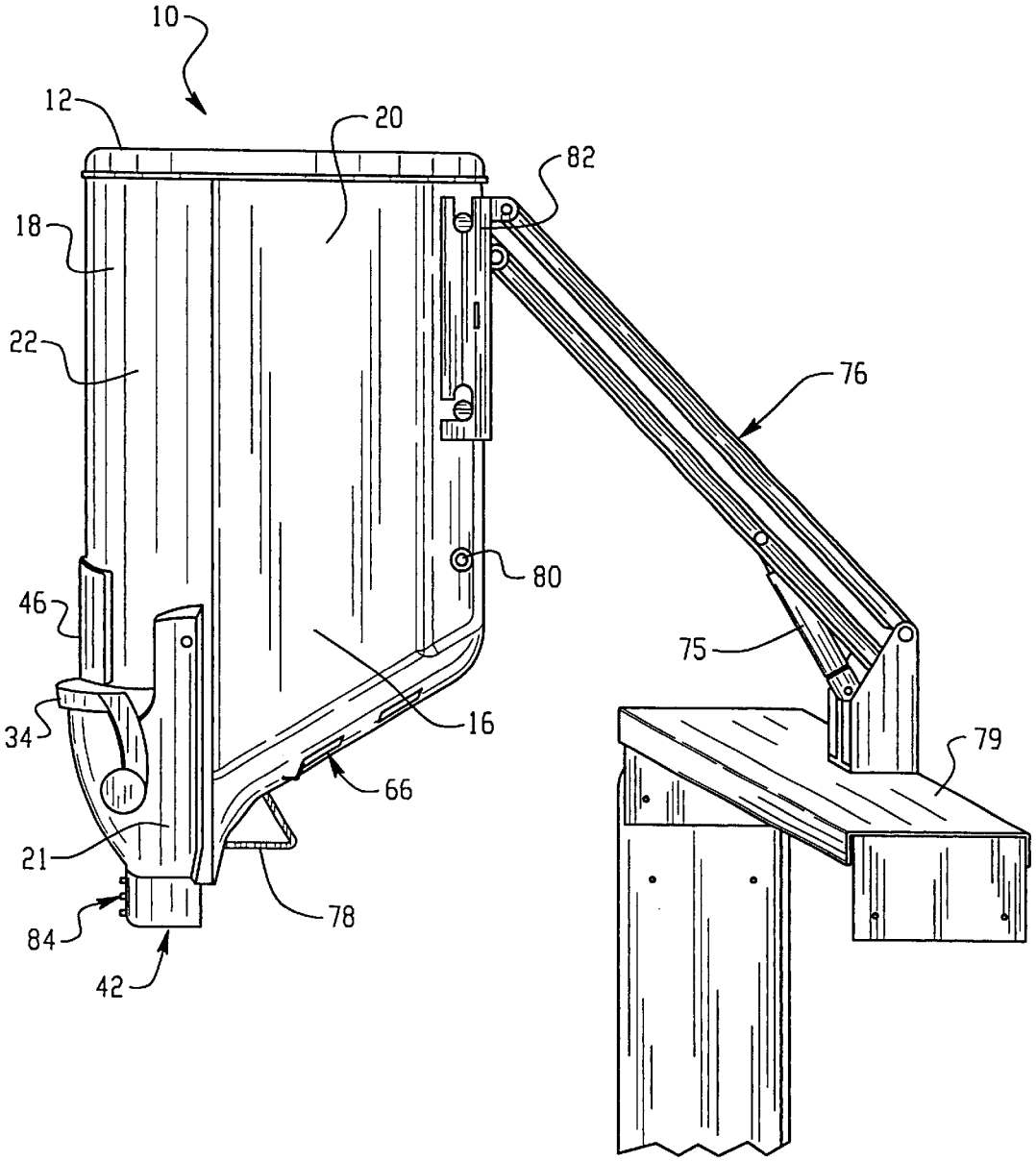
FIGS. 2A–2B show a right side view of the gravity feed bin of FIG. 1 being supported in extended and resting position, respectively, by a scissors support device according to a preferred embodiment of the present invention.
Figure 2B:
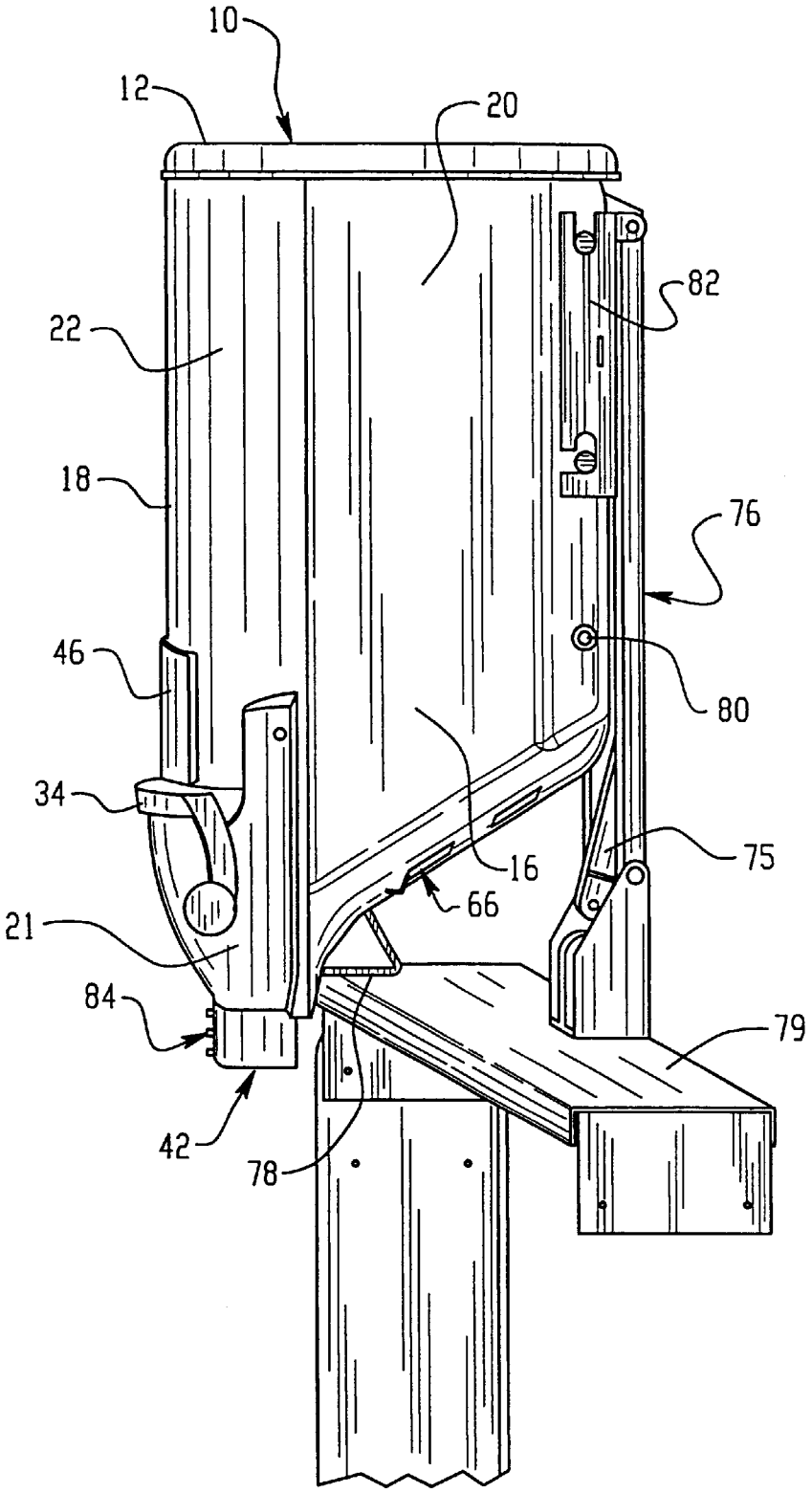

As can be seen in FIGS. 1 and 2A–2B, the material in the third cavity 22 is easily seen by the customer because of a curvature of the front piece 18. This curvature holds the bulk material so as to allow it to be seen by the customer when viewed from the front or the side. Also, the third cavity 22 provides for an attractive point-of-sale display of the bulk material giving the consumer the impression that the bin is full. In order to completely and effectively inform a customer about the bulk material, i.e., its cost, make-up, calories, size, etc., a printed display or sign can be held by a display holding device 46 located on an outside surface of the front piece 18.

As can be seen in FIGS. 1 and 3A–C, an operator can interact with a adjustable-flow control device 48 through an opening 50, which is adjacent the display holder 46. This interaction can occur either when the handle 34 is in a lowered position, or with the handle in an at rest, raised position. Flow rate of the bulk material is controlled by the size of the opening 24 exposed by the rotating door 28. The exposed amount of the opening 24 is adjusted by an operator by inserting an elongated object 52, e.g., a screwdriver, through the opening 50. By doing this, the operator can interact with the adjustable-flow device 48. This adjustable-flow device 48 is preferably configured as a stopper that limits the upper most rotation of the rotating door 28, such that more rotation exposes more of the opening 24 and that less a degree of rotation exposes less of the opening. The movement of rotating door 28 is limited by the position of adjustable-flow device 48 along a track 53. The adjustable-flow device 48 is secured at different positions along the track 53 through use of teeth 54.

Figure 3A:
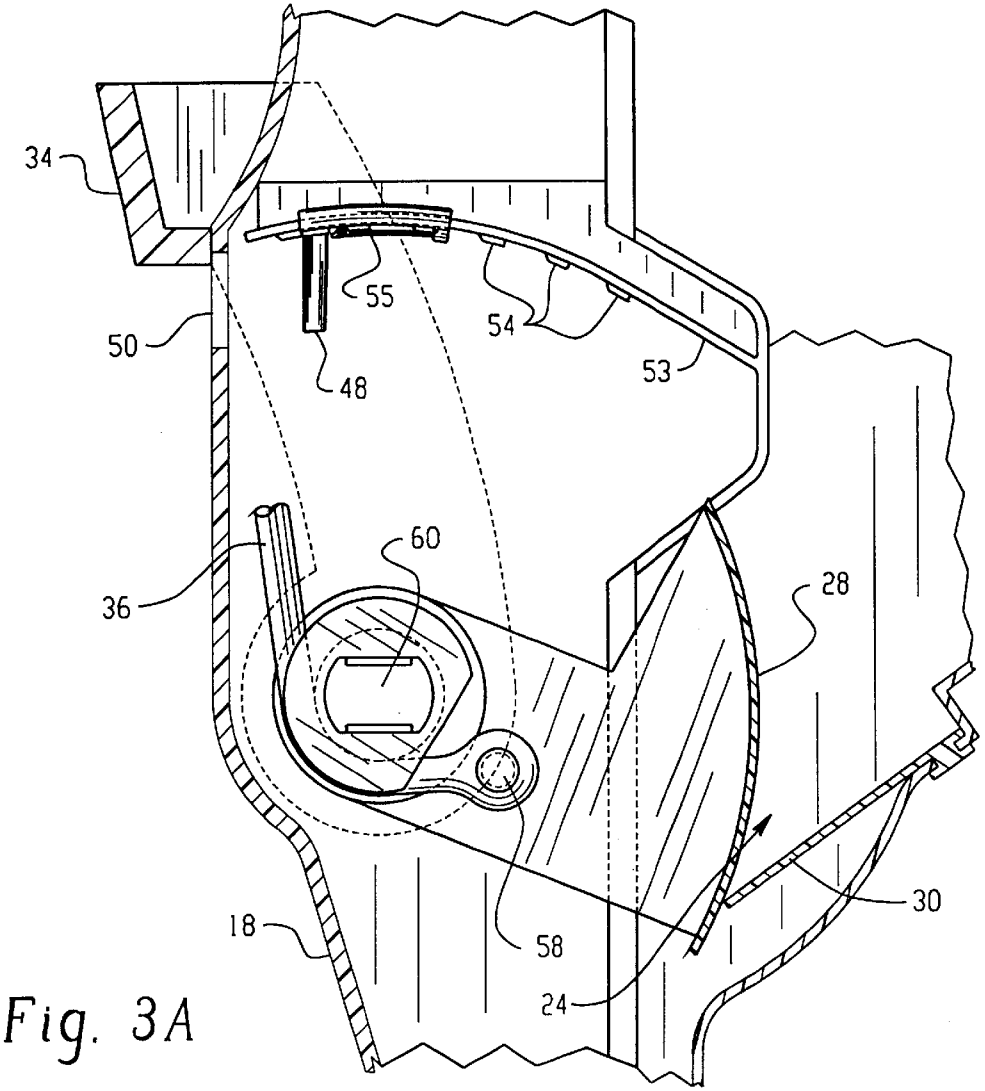
FIGS. 3A–3C show the placement and operation of a feed flow adjustment device of the gravity feed bin in FIG. 1.

In FIG. 3A, the adjustable-flow device 48 is shown positioned so as to allow the rotating door 28 to have a full range of motion, thus exposing a maximum amount of opening 24. To limit the maximum rate of flow of the bulk material, adjustable-flow device 48 is moved in the direction of the arrow in FIG. 3B through use of the elongated device 52. This interaction of elongated device 52 with adjustable-flow device 48 exerts enough pressure on adjustable-flow device 48 so that it slides along the teeth on surface 53. Once the adjustable-flow device 48 has been moved into a desired position, it is captively retained by teeth, as at 54.

Figure 3B:
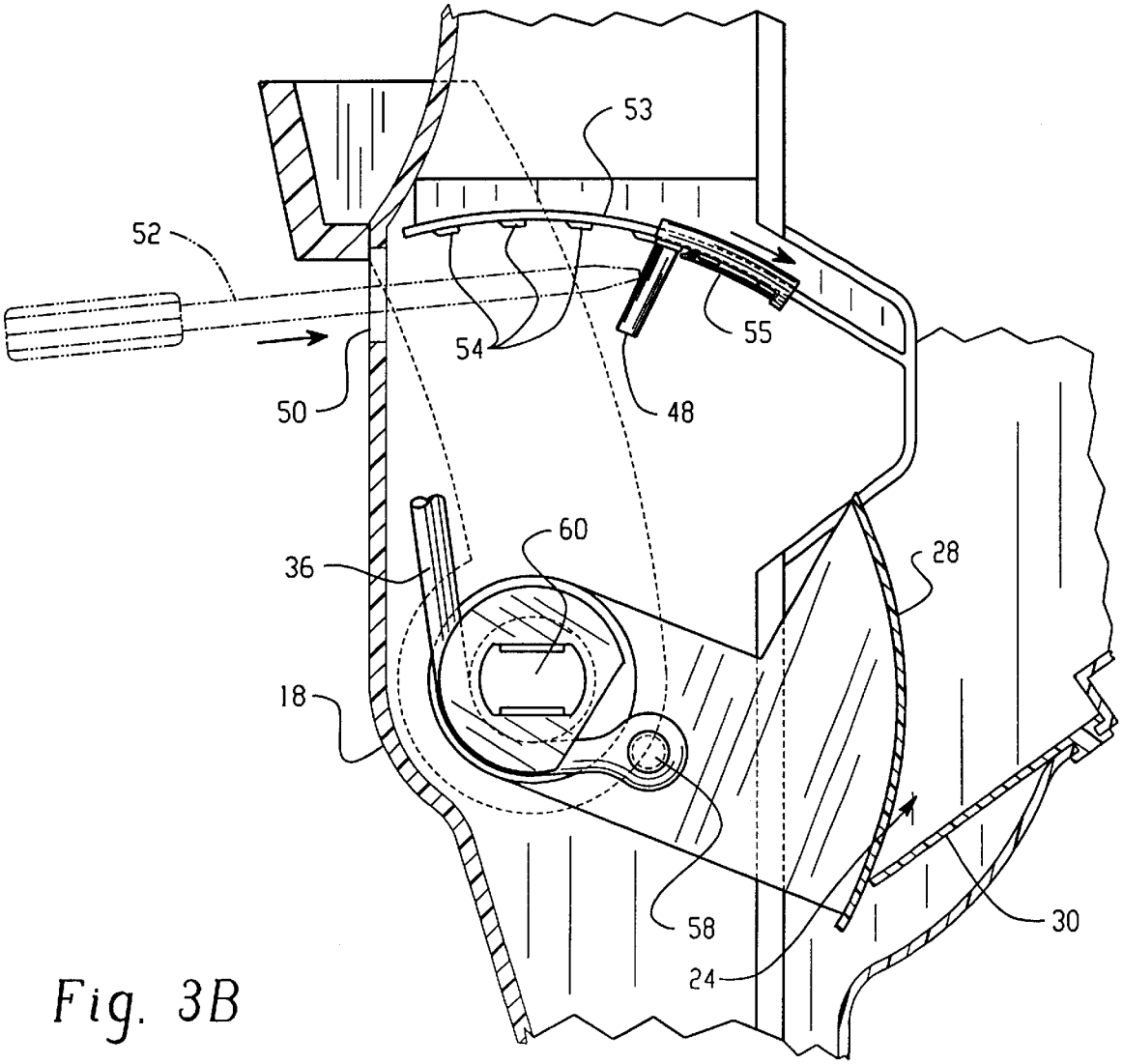
Figure 3C:
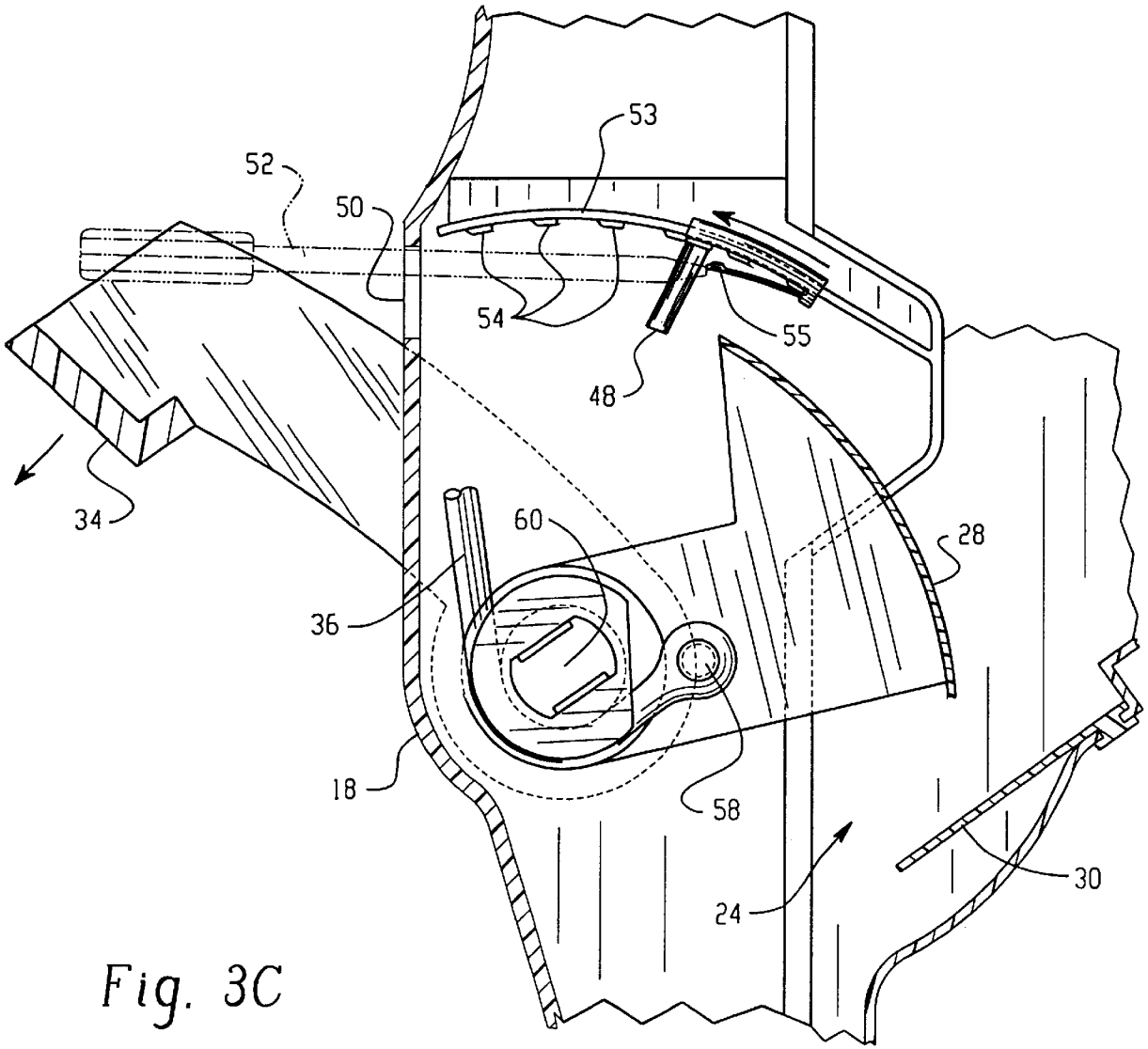

To increase the rate of flow of the bulk material, adjustable-flow device 48 is moved in the direction of an arrow in FIG. 3C, which is opposite the arrow in FIG. 3B. This is accomplished by sliding the end of elongated device 52 under a retaining clip 55 of the adjustable-flow device 48 thus disengaging the retaining clip 55 from the teeth 54 allowing adjustable-flow device 48 to slide along track 53.

Then, the elongated device 52 is pressed against the adjustable-flow device 48 with enough force to overcome the friction between the elongated device and adjustable-flow device , thus allowing the operator to pull the adjustable-flow device towards the opening 50. Again, once the adjustable-flow device 48 is in a desired position, it is captively retained in position by teeth 54.

Preferably, during operation, the exposed space of the first opening 24 can also be enlarged or reduced to accommodate a plurality of sizes of bulk materials available. Accordingly, if material of a small sized, e.g., ground coffee or metal washers, is being dispensed, the opening 24 is correspondingly reduced. If material of a larger size, e.g., medium to large pasta or metal bolts, is being dispensed, a larger opening 24 would be preferred.

Figure 4A:
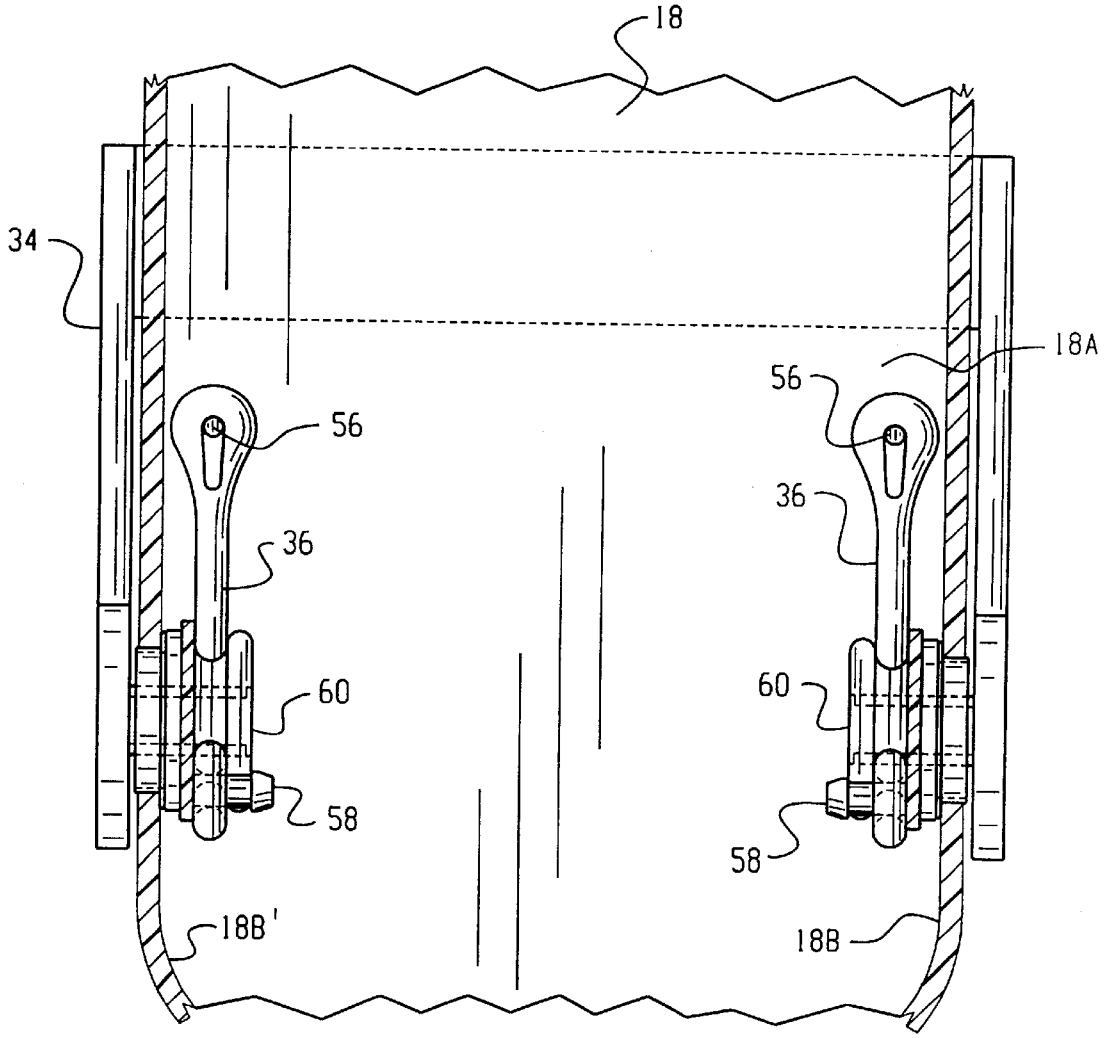
FIGS. 4A–4C show the placement of a biasing member on extensions from several inside surfaces of a front face of the gravity feed bin in FIG. 1.
Figure 4B:
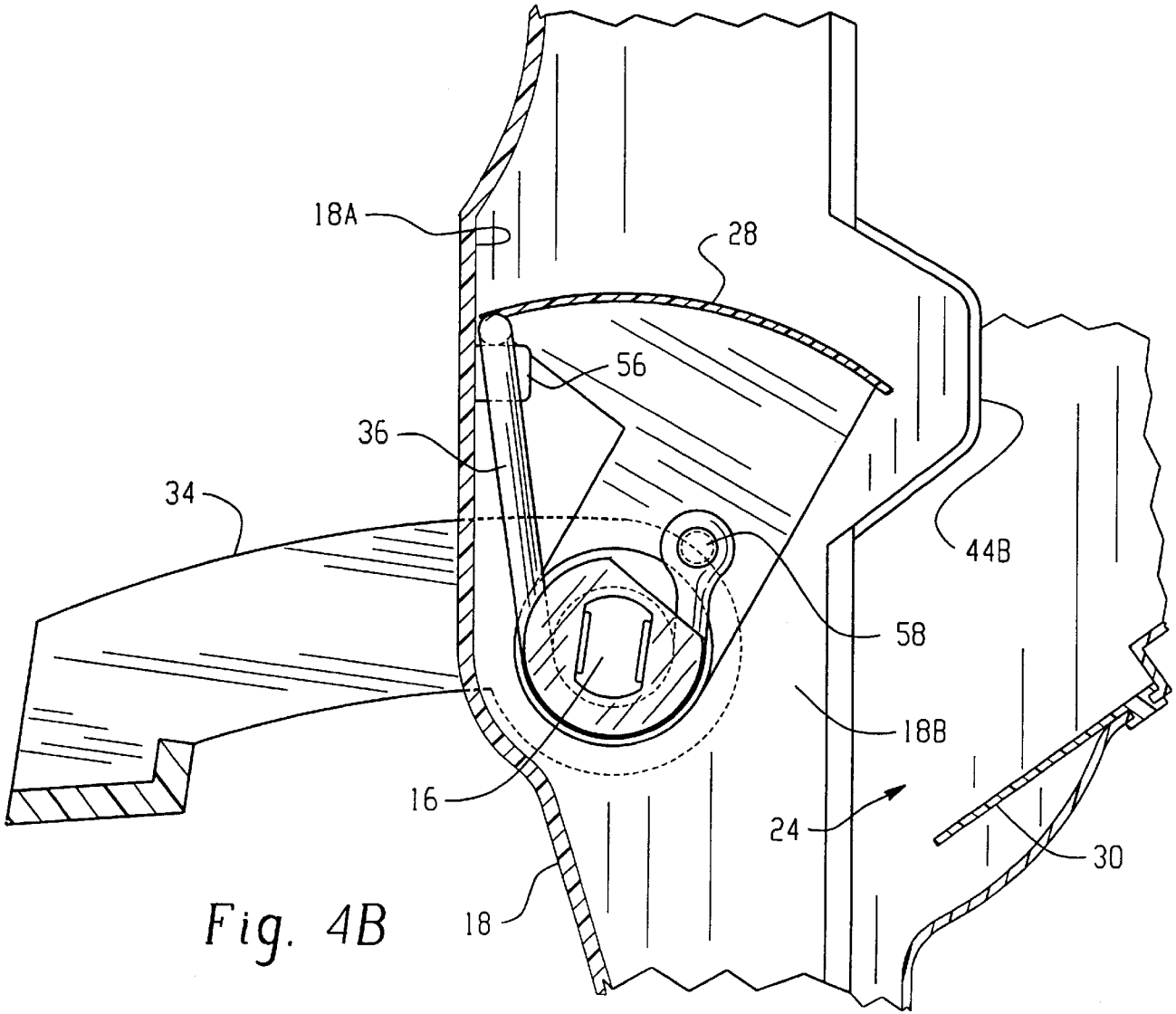
Figure 4C:
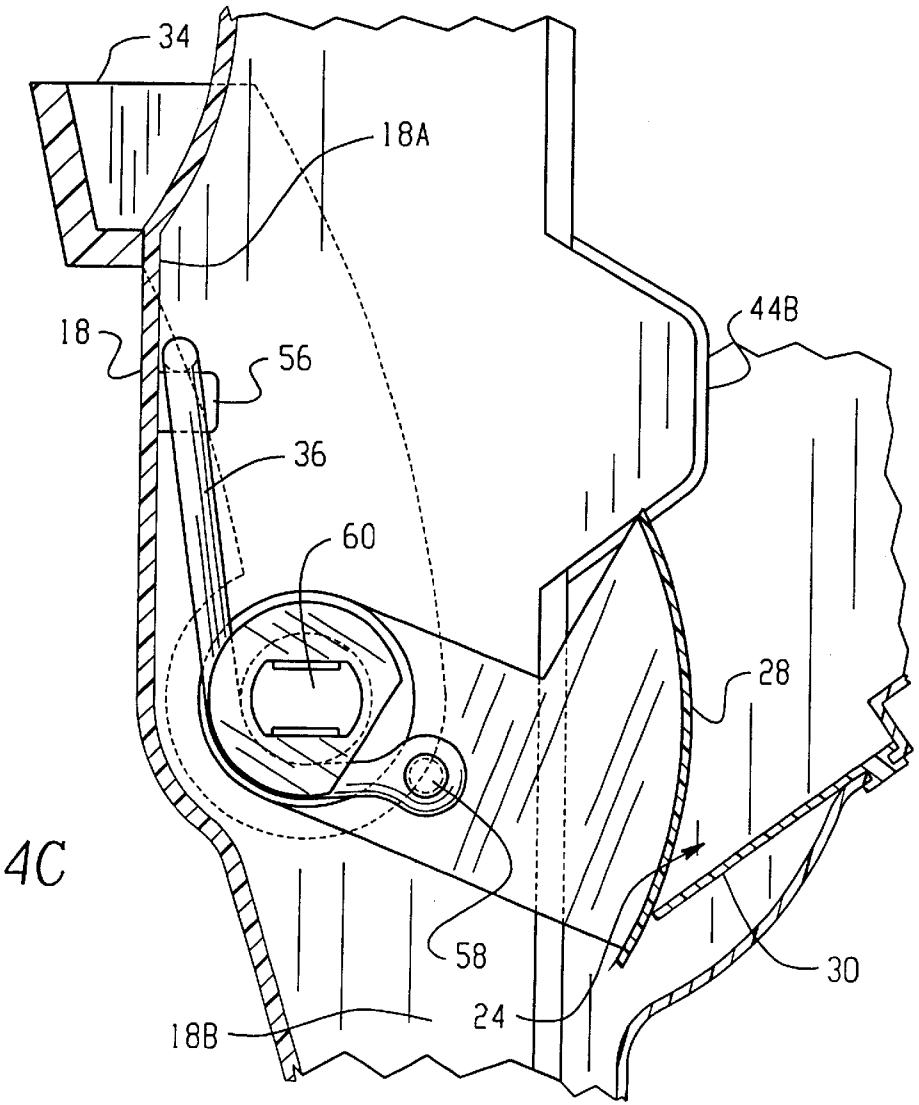

Turing now to FIGS. 4A–4C, a more detailed view of the connection of the biasing devices 36 to the front face 18 is shown. In these Figures, FIG. 4A is a view from the inside surface of front piece 18, and FIGS. 4B–4C are views with right side section 16 removed. As can be seen from these Figures, a first preferably looped end of each of two biasing device 36, is attached to first and second extensions 56, which are preferably molded pegs extending from the inside surface 18A of the front piece 18. A second, preferably looped end of each of the biasing devices 36 is attached to third and fourth extensions 58, which are likewise preferably molded pegs extending from opposite inside side surfaces 18B and 18B' of front piece 18. A middle section of each of the biasing devices 36 is wrapped partially around and biased against and under a lip of fifth and sixth cylindrical extensions 60, which are located adjacent to the third and fourth extensions 56 on the two opposite inside side surfaces 18B,18B' of front piece 18.

Through the use of these biasing devices 36, the handle 34 is automatically returned to its upward normally closed resting position after the customer has finished dispensing the desired amount of bulk material. Also, through use of this preferred assembly of the biasing devices 36 on the inside surface 18A and the side inside surfaces 18B, 18B' of the front cover 18 near the outlet 42, there is minimal contact, if any, between the bulk material and the biasing devices. This minimal contact reduces damage to either the biasing devices 36 or the dispensed bulk material, while also reducing the chance of contamination of the bulk material which could be imparted from a soiled biasing device.

Figure 5A:
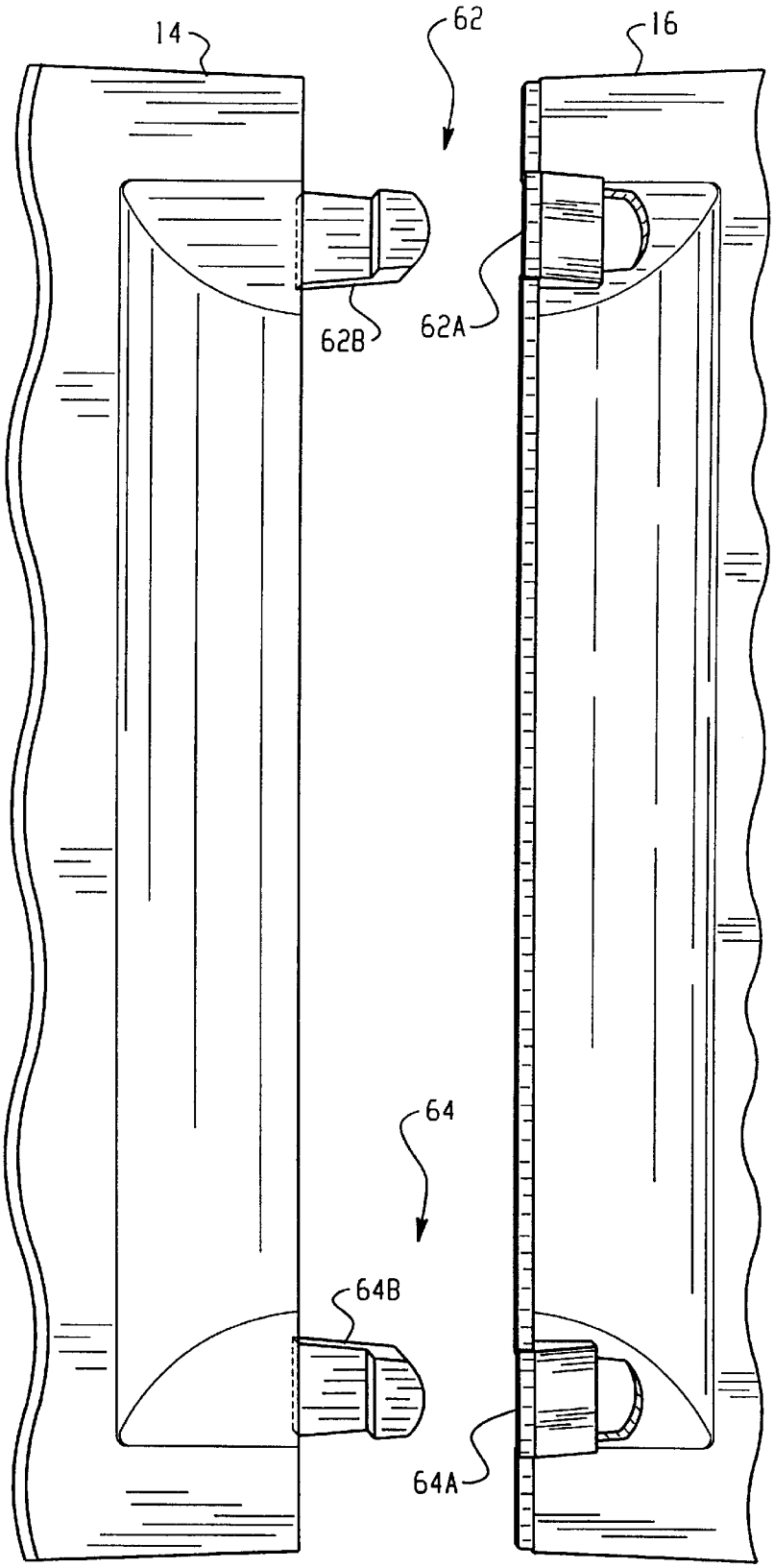
FIG. 5A shows upper and lower latches utilized to interconnect front sections of a first and second side pieces to form an assembled body of the gravity feed bin in FIG. 1.

Turning now to Figure 5A, front sections of the right and left side pieces 14, 16 are shown. The front sections of the right and left side pieces 14, 16 are pivotally moved together and then captively retained with one another using forwardly biased inter-connecting device pairs 62 and 64. To connect the right and left side pieces 14, 16, a female portion 62A receives a male portion 62B of the connecting device 62, and in similar fashion a female portion 64A receives a male portion 64B of the connecting device 64. The forward bias of connecting devices 62B and 64B when engaged with corresponding device portions 62A and 64A, causes the left and right side pieces to be secured to one another until manually disengaged.

Figure 5B:
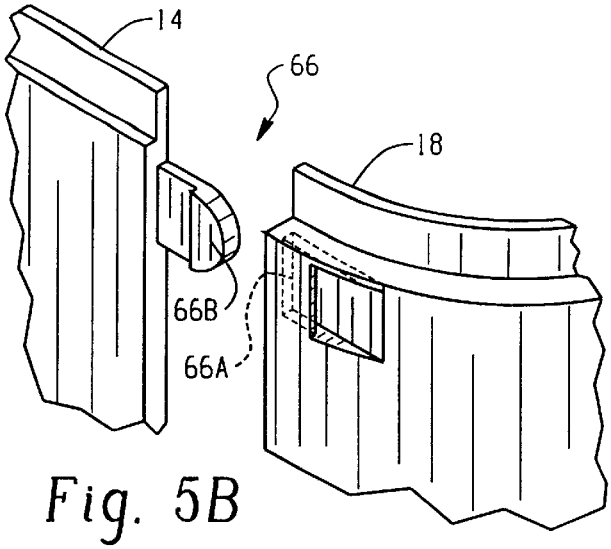
FIG. 5B shows a latch utilized to interconnect the front piece to the assembled body of the gravity feed bin in FIG. 1.

Referring now to FIG. 5B, there is shown the connecting device pair 66 front piece 18. This connection is formed through a connecting device 66. Similar to what was described above, a female portion 66A receives a male portion 66B of the connecting device 66.

It is to be appreciated that although the male portions B are shown as being integral with the right side piece 16, in an alternative configuration the left side piece 14 could include the male portions B.

Figure 6A:
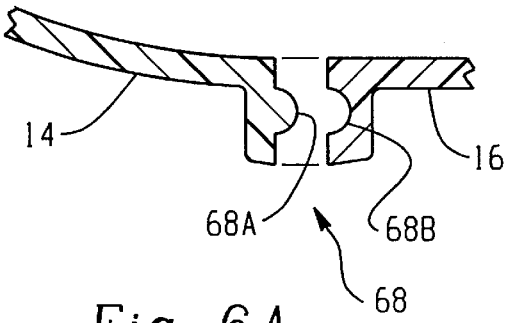
FIGS. 6A–6B show a latch for interconnecting bottom sections of the first and second side pieces of the gravity feed bin according to a first preferred embodiment of the present invention in FIG. 1.
Figure 6B:
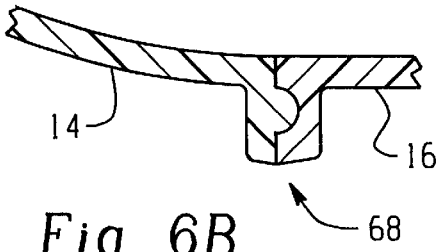
Figure 5C:
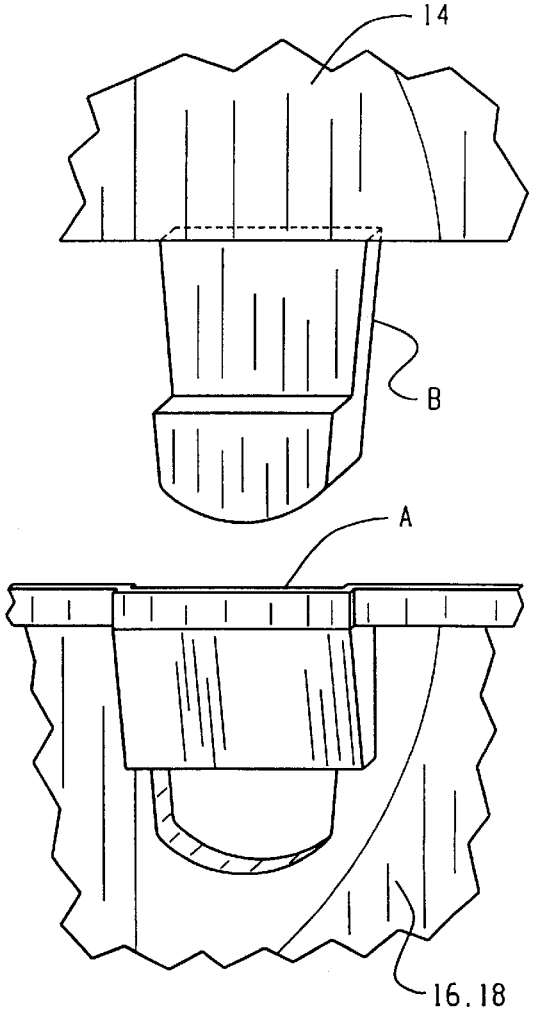
FIG. 5C is an enlarged view of the latch in FIGS. 5A–5B.

A first embodiment of a overlapping seam 68 that forms a seal at the bottom most extent of the right and left side pieces 14, 16 is shown in FIGS. 6A–6B. In order to form this seal, an elongate ridge 68A extending from a lip that extends normal to an outside surface of the bottom section of the right side piece 14 is received in an elongate channel 68B formed in a lip that extends normal to an outside bottom surface of the bottom section of left side piece 16. This seal 66 prevents the bottom sections of right and left side pieces 14, 16 against each other during use that could result in a momentary separation of the right and left side pieces 14, 16, where the stored bulk material could then lodge between them.

Figure 6C:
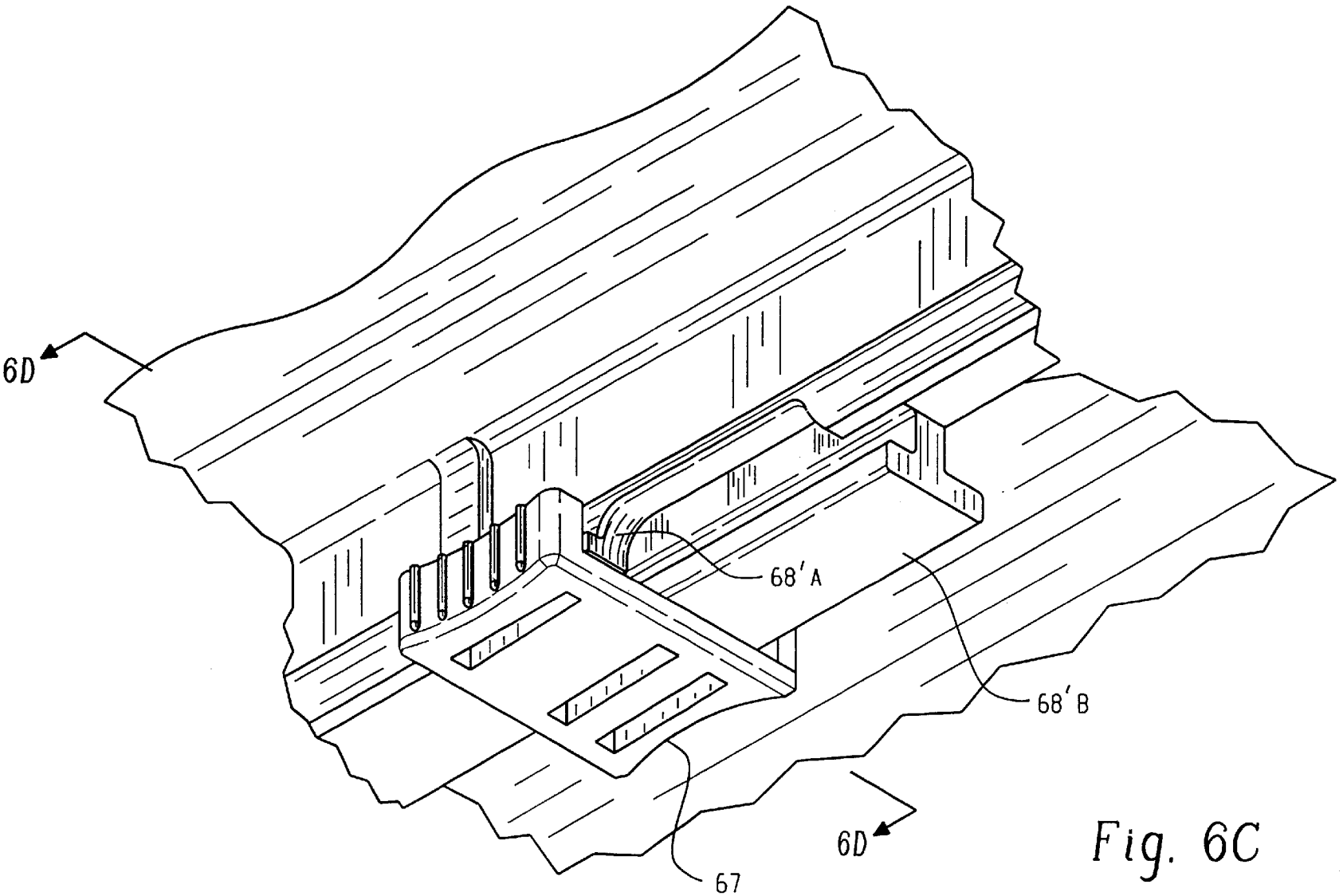
FIG. 6C shows a closing assembly for securing the bottom sections of the first and second side pieces of the gravity feed bin according to a second preferred embodiment of the present invention in FIG. 1.
Figure 6D:
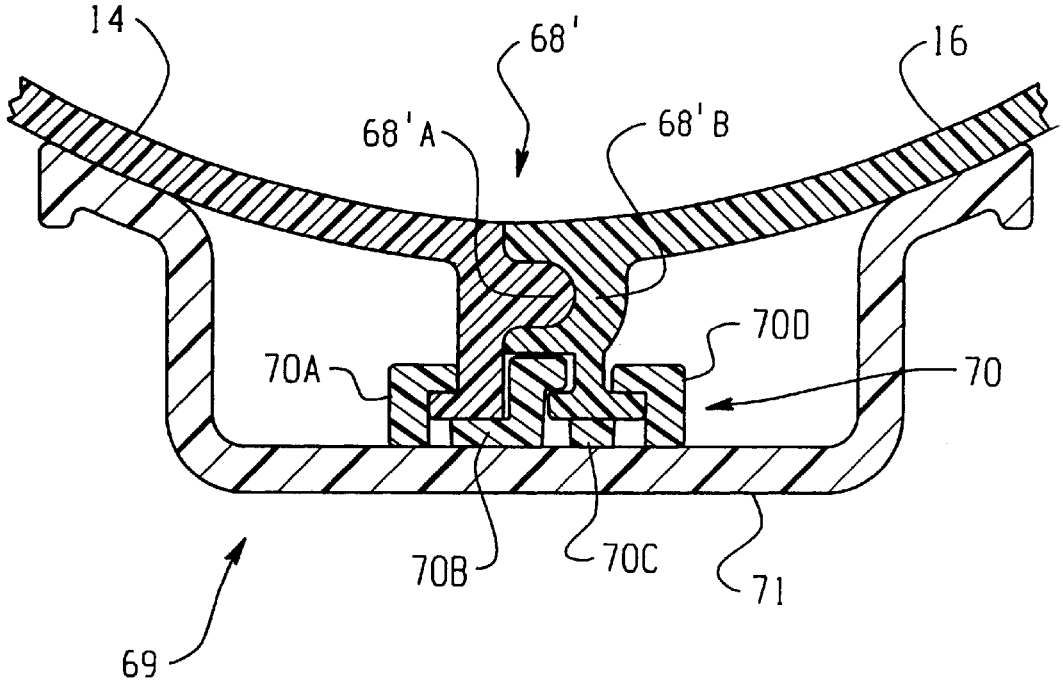
FIG. 6D shows a cross-sectional view along line 6C–6C in FIG. 6C of the closing assembly.

With reference to FIGS. 6C and 6D, a second and preferred embodiment of a bottom seal clamp 69 is shown that includes overlapping elongate ridge 68'A and elongate channel 68'B, each having structural extensions corresponding and complimentary to the structural elements 70A–D of a sliding clamp 70. Together, structural seal 68" and sliding clamp 70 are employed to securely interconnect the bottom most extents of left and right side sections 14, 16. The sliding clamp 70 extends from a clamp base member 71. This bottom seal clamp 69 is preferably utilized when it is desirable to ensure a more secured connection between the bottom sections than that attained through the use of unclamped overlapping seam 68 as shown in FIGS. 6A–6B. In operation, the bottom seal clamp 69 is formed through the interconnection of a elongate ridge 68'A, which extends outwardly from the bottom most section of left side section 14, where connecting piece 68'A is slideably engaged between structural members 70A and 70B of the sliding clamp 70. The sliding clamp 70 further structural members 70C and 70D, which in cooperation with member 70B, captively engage a section 68'B that extends outwardly from the bottom most right side piece 16. Through this bottom seal clamp 69, the chance of the bottom sections of left and right side sections 14, 16 separating under the load of the contained materials is substantially eliminated.

Figure 7A:
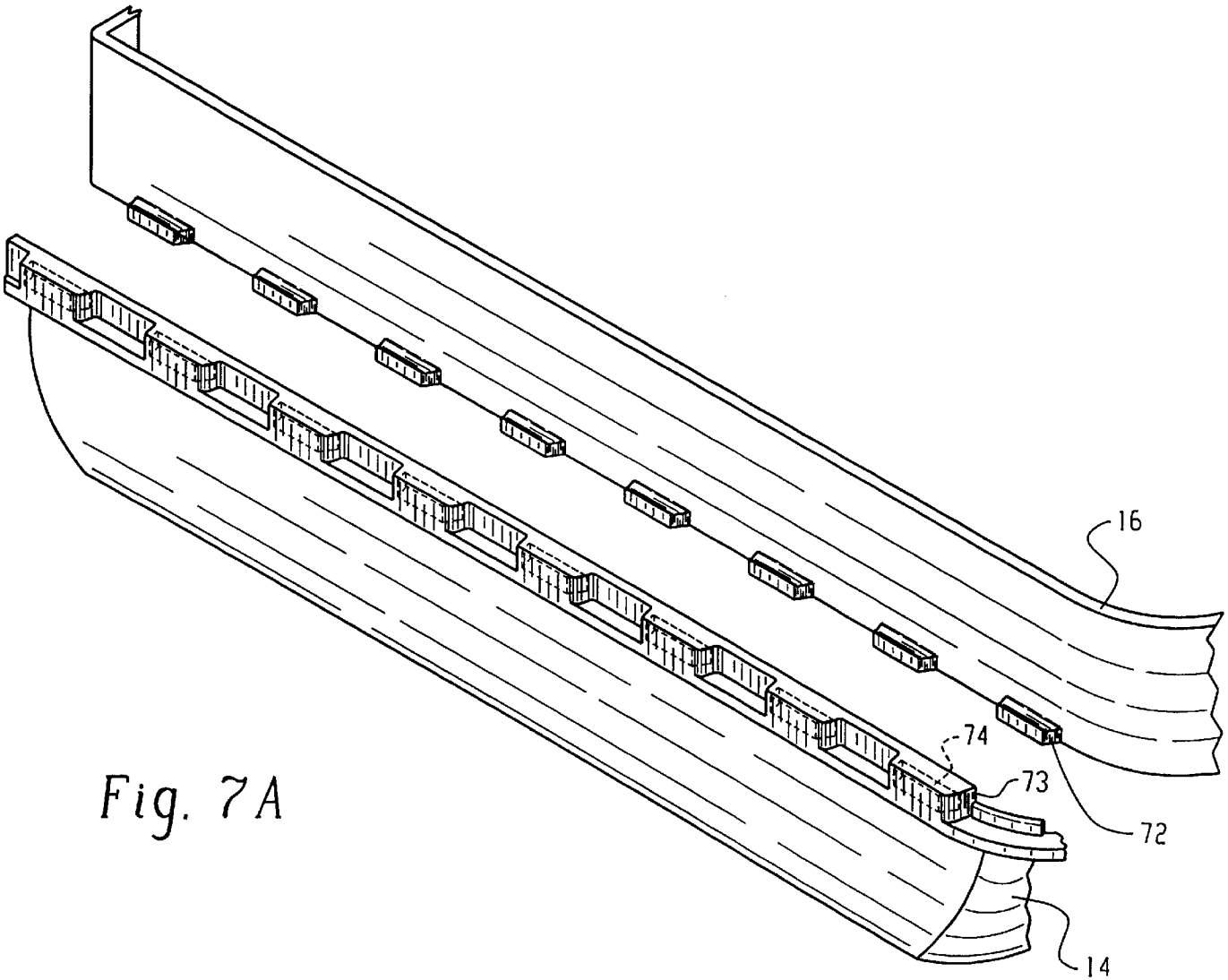
FIG. 7A–7B show a hinge assembly utilized to hingedly connect the first and second side pieces of the gravity feed bin in FIG. 1.
Figure 7B:
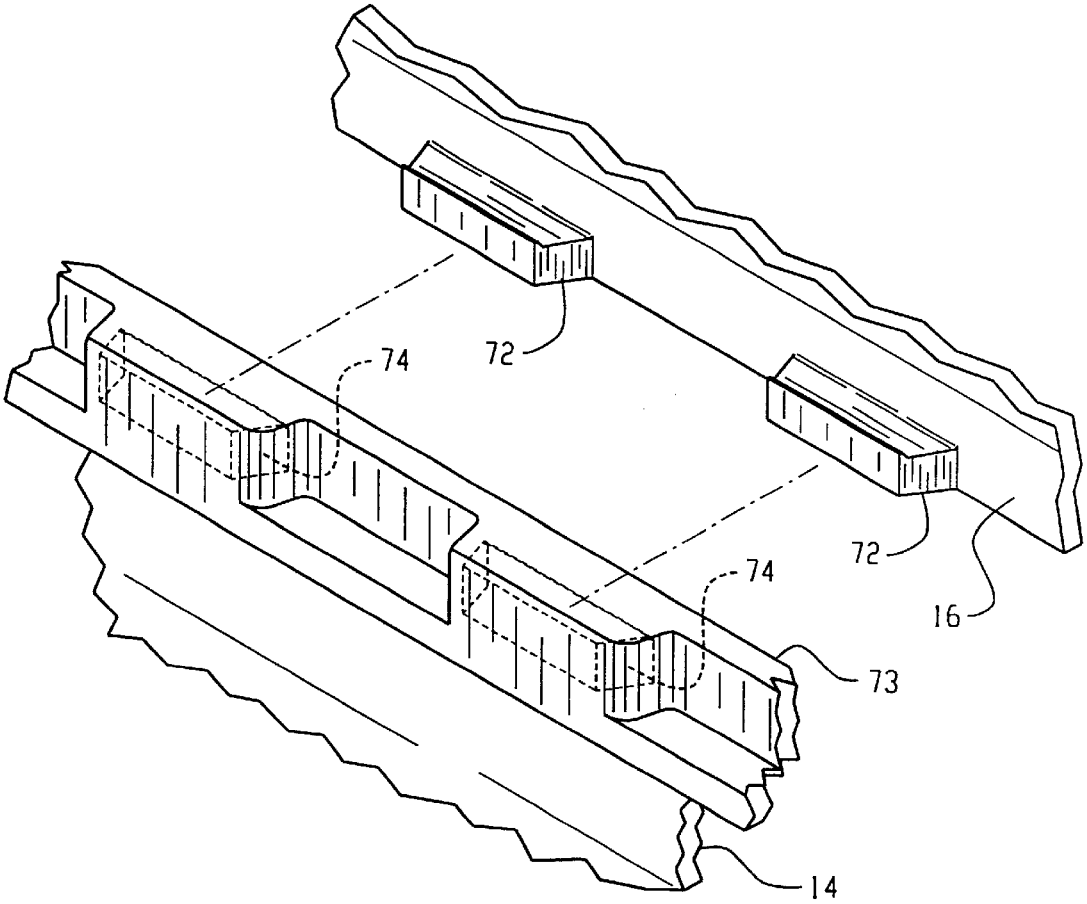
Figure 8B:
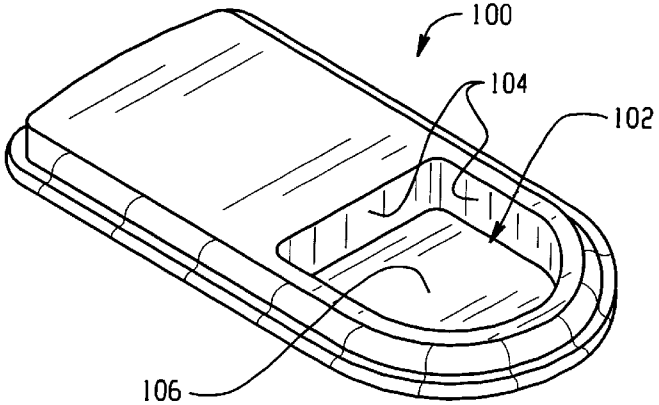
FIG. 8B shows a prospective view of the closing device in FIG. 8A.
Figure 8D:
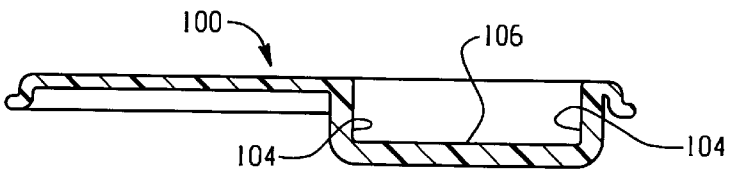
FIG. 8D shows a cross-sectional side view of the closing device viewed from line D—D in FIG. 8A.
Figure 8A:
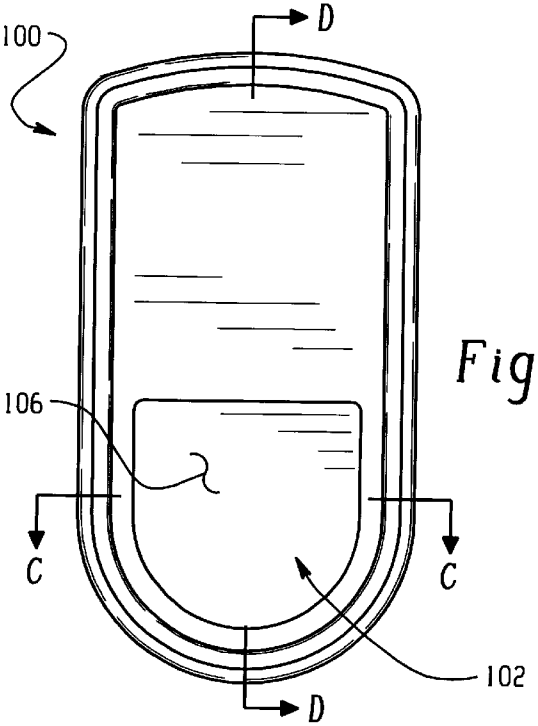
FIG. 8A show a top view of a closing device according to a third embodiment of the present invention.
Figure 8C:
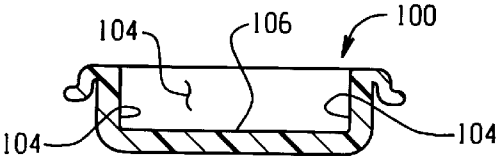
FIG. 8C shows a cross-sectional end view of the closing device viewed from line C—C in FIG. 8A.

Referring now to FIGS. 7A–7B, the rear most portions of the left and right side pieces 14, 16 include a plurality of male hinge elements and female hinge elements 72 and 74, respectively. Preferably, the male and female hinge elements 72, 74 are configured along the entire rear most extents of sides 14 and 16 to form a quickly disengageable hinge system enabling bin 10 to be readily opened for cleaning. In operation, male hinge elements 72, which extend normally from a back outside surface of the right side piece 16, are received by female hinge elements 74, which are formed in a lip section 73 extending normally to a back outside surface of the left side piece 14.

Returning to FIGS. 1 and 2A–2B, several features are provided for the convenience of the operator and customer are shown. A first such device is a bin support device 76, which consists of an upwardly biased scissors type support arrangement. As shown in FIGS. 2A and 2B, a biasing means, such as a pneumatic cylinder 75 may be provided, however other means, such as springs or other tensioning devices may be used to bias the bin 10 towards it operational position, as shown in FIG. 2B. To access the bin 10 for filling or cleaning, an operator moves the bin from its operating position, shown in FIG. 2B, to its service position, as shown in FIG. 2A and then removes lid cover 12. Once serviced, bin 10, with the upward assistance of bin support device 76, is returned to its operating position where support bracket 78 preferably is allowed to rest upon a stationary shelving support, as at 79. Bin support device 76 is coupled to bin 10 through a coupling system, where molded extensions 80 interact with bracket-type devices 82 located on either side of the bin.

A second feature that is employed as a convenience to customers is the placement of a friction device 84 such as a series of parallel ribs molded into spout area 42 of the front piece 18. In this regard, the ribs 84 assist a customer during the dispensing of materials through outlet 42 by providing a better grip than provided by an otherwise smooth surface.

With reference to FIGS. 8A–D, a closing device 100 according to a third embodiment of the present invention in shown. The closing device 100 includes a holding device 102 that gives a customer a "third hand" to support the weight of a receptacle, i.e., a bag, while the receptacle is being filled. A customer's first hand would be pulling on the external handle 34 to release the bulk material and their second hand would be holding the receptacle. This holding device 102 includes first through fourth side walls 104 and a base 106. Also, when the customer is done filling, a substantial amount of any spill-over is caught on the base 106, which can be easily cleaned. By catching a substantial amount of the spill-over, the floors around the gravity feed bins remain virtually clean, which results in a safer, more sanitary, and attractive area.

Figure 9B:
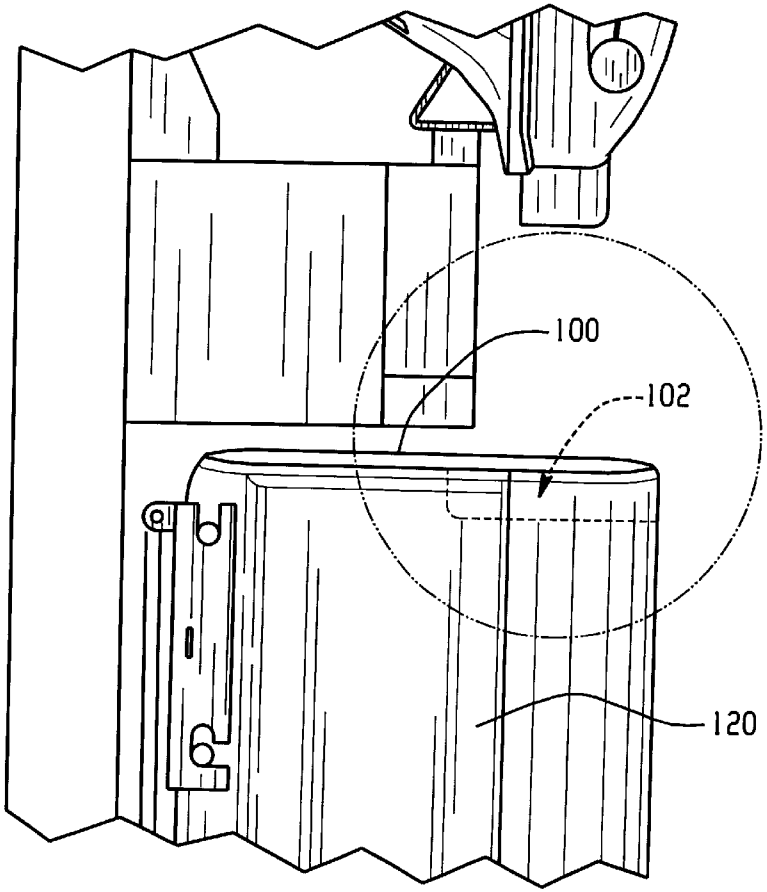
FIG. 9B shows a close up view of the system in FIG. 9A.
Figure 9A:
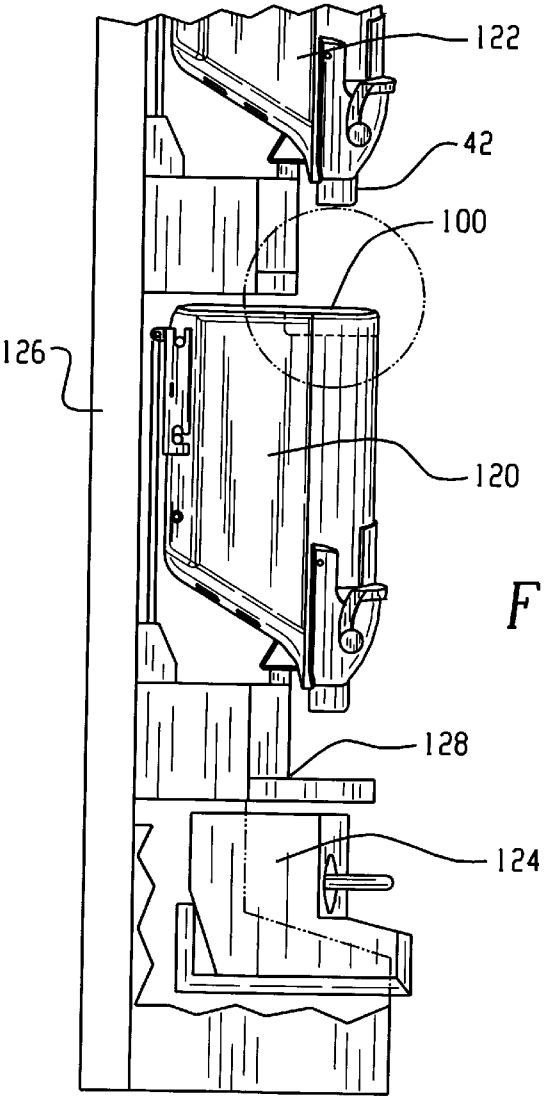
FIG. 9A shows a side view of a system including a gravity feed bin with the closing device in FIGS. 8A–D.

Turing now to FIGS. 9A and 9B, a gravity feed bin 120, similar in function to the gravity feed bin described in FIGS. 1–7, including the closing device 100 is shown. The gravity feed bin 120 is positioned below a second gravity feed bin 122 and above a scoop bin 124, where these bins 120–124 are supported through use of a support structure 126. As is clearly seen, the holding device 102, outlined in dotted-lines in FIG. 9B, is position directly below the outlet 42 of gravity feed bin 122. Hence, the holding device 102 can hold a receptacle while a consumer is dispensing bulk materials and catch any spill-over in the base 106. Also, the system 126 includes an holding device 128 that can also hold a receptacle while it is being filled with bulk materials, as well as, being able to catch any spill-over.

From the above description of the invention, those skilled in the art will perceive improvements, changes and modifications in the invention. Such improvements, changes and modifications within the skill of the art are intended to be covered by the appended claims.

I claim:

1. An apparatus for dispensing stored materials contained therein, comprising:

first and second side pieces interconnected to form an interconnection along at least one side, the interconnection of the first and second side pieces forming a cavity;

a front piece opposing the interconnection and interconnected with the first and second side pieces to secure the same;

a lid for covering at least said cavity;

a handle coupled to a rotating door, said door being located between said cavity and another cavity and being actuable to release a determinable amount of stored material contained in at least said cavity to said another cavity;

a biasing device coupled to said rotating door for maintaining said door in a normally closed position when said door is not actuated;

a resilient sealing device nestingly coupled with said rotating door to substantially seal an opening between said first and second cavity; and an outlet at the bottom of said another cavity for dispensing said stored materials therefrom.

2. The apparatus according to claim 1 wherein the lid includes a holding device.

3. The apparatus according to claim 2 wherein the holding device includes first through fourth side walls and a base.

* * * * *